US005676601A

United States Patent [19]

Saunders

[11] Patent Number: 5,676,601

[45] Date of Patent: Oct. 14, 1997

[54] CAROUSEL APPARATUS

[76] Inventor: Stuart Edward Saunders, 65 Colville Rd., Oulton Broad, Lowestoft, Suffolk, England, NR33 9RD

[21] Appl. No.: 624,505

[22] PCT Filed: Oct. 4, 1994

[86] PCT No.: PCT/GB94/02158

§ 371 Date: Apr. 5, 1996

§ 102(e) Date: Apr. 5, 1996

[87] PCT Pub. No.: WO95/10340

PCT Pub. Date: Apr. 20, 1995

[30] Foreign Application Priority Data

Oct. 9, 1993 [GB] United Kingdom ..... 93 20841.1

[51] Int. Cl.[6] ..... A63G 1/08

[52] U.S. Cl. ..... 472/29; 472/3; 472/107

[58] Field of Search ..... 472/3, 4, 5, 28, 472/29, 106, 107, 39, 1

[56] References Cited

U.S. PATENT DOCUMENTS

| | | | |
|---|---|---|---|
| 1,553,528 | 9/1925 | Hartonz | 472/29 X |
| 3,078,091 | 2/1963 | Burke | 472/5 |
| 3,191,930 | 6/1965 | Cottrell | 472/29 X |
| 5,395,290 | 3/1995 | Knifpstra | 472/29 X |

FOREIGN PATENT DOCUMENTS 2405078 5/1979 France .

*Primary Examiner*—Kien T. Nguyen

[57] ABSTRACT

A carousel comprises turntable (10) mounted for rotation about a vertical axis on a frame (12, 13). The turntable (10) carries a plurality, and typically four, see-saw arrangements (11), each of which comprises an arm (43) pivoted centrally to a support (40) and carrying seats (44) at its two ends. Hydraulic rams are arranged to effect movement of the arm (43), as the turntable rotates. The movement of the arms may be linked to the rotation of the turntable. The see-saws may be aesthetically configured to add appeal to young children.

14 Claims, 9 Drawing Sheets

CAROUSEL APPARATUS

This invention relates to carousel apparatus and in particular to such apparatus having a rotatable turntable and a plurality of seats carried by the turntable, for users of the apparatus.

There have been innumerable designs of carousel apparatus (referred to hereinafter as a carousel) intended to give users of the carousel an enjoyable ride, for example at a fun fair, play ground or an entertainment or theme park. A carousel may be made to give a more or less exciting ride dependent upon the ages of the intended riders, but particularly in the case of carousels intended for use by children, many carousels are unimaginative and do not give much excitement. For example, the turntable may carry rather crude representations of motor vehicles, aeroplanes and boats, which representations are provided with static seats (relative to the turntable) and which thus merely carry the children round and round, as the turntable rotates.

In DE-C-42,927, there is described a children's carousel having a dragon-like structure made up from a number of links pivoted end-to-end, with a seat bridging each pivotal connection of one link to the next. A crank arrangement is coupled to one pivotal connection, to cause relative pivoting movement between the links. Such an arrangement is complex and leads to compound movements which may be excessive for small children.

In U.S. Pat. No. 3,968,961, there is described a traditional carousel having rising and falling horses on which children may ride, but which has a cam track disposed below the carousel platform, each horse being mounted on a post upstanding from a cam follower also arranged below the platform.

There are of course more sophisticated designs of carousel, intended to give very much more exciting rides, but these then are unsuitable for use by young children. It is therefore a principal aim of the present invention to provide a carousel which is suitable for use by young children but which is configured to give an interesting and perhaps exciting ride, whilst at the same time which is relatively simple and so inexpensive to construct and operate.

According to the present invention, there is provided carousel apparatus comprising a turntable rotatably mounted for rotation about a vertical axis, a plurality of pairs of arms disposed around and pivotally mounted on the turntable, each arm supporting a respective seat at or adjacent its end remote from its pivotal mounting to the turntable, power-turning means to effect rotation of the turntable, and drive means to effect pivoting movement of the arms and so raising and lowering of the seats, the pivoting movement of the arms of each pair being in antiphase whereby the two seats of each pair of arms are alternately raised and lowered during rotation of the turntable.

It will be appreciated that a child sitting on a seat of a carousel constructed and arranged in accordance with the present invention will be subjected both to vertical and centripetal accelerations during operation of the carousel and so will experience a much more exciting ride than is the case where the child is merely carried round in a static piece of equipment mounted on a turntable. On the other hand, the carousel is relatively simple and so may be constructed to give a high degree of safety to young children. Moreover, the carousel may be manufactured relatively simply and so cheaply, and also may be reliable in operation.

The two arms of each pair may together comprise a single elongate lever pivoted at its mid-point to the mounting on the turntable, the two seats being mounted one on each end of the lever, so as to define a see-saw. Alternatively, the two arms of a pair thereof could be separate but aligned and each pivoted to the turntable at one end and having a seat at the other end, the two pivotal mountings being adjacent one another. In either case, it is preferred for the pivotal axis for the two seats of each pair to extend substantially radially of the turntable.

The drive means for the seats may operate in a timed relationship to rotation of the turntable. For example, there may be a stationery cam track and a plurality of cam follows associated with the seats, which cam followers are arranged to run along the cam track during turntable rotation so as thereby to effect raising and lowering of the seats. In the alternative, hydraulic rams-may be provided to effect raising and lowering of the seats, in antiphase. A control arrangement for those rams may operate independently of the angular rotation of the turntable, or may be linked thereto.

The power-turning means for the turntable may comprise a hydraulic motor together with a source of hydraulic fluid under pressure, driven for example by an electric motor or a diesel or petrol engine. Alternatively, the turntable may be directly driven, for example by an electric motor.

Preferably, the carousel apparatus is arranged as a self-contained apparatus having a base frame which may be provided with ground wheels, whereby the carousel may be moved from place to place. In the alternative, the apparatus may be made static, with the base frame securely attached to the ground at a suitable site.

In order to render the carousel of this invention attractive to children, it is preferred for the turntable to be furnished with appropriate decorations. Moreover, the seats may be made more attractive to children, for instance by arranging for the seats to rise and fall within an animal-like or other housing. Alternatively, the seats may be provided with an animal-like or other housing which is itself secured to the associated arm to rise and fall therewith. In either case, the housing may both be visually appealing and offer protection to a person seated therewithin.

By way of example only, certain specific embodiments of the present invention will now be described in detail, reference being made to the accompanying drawings, in which.

Figure 1:
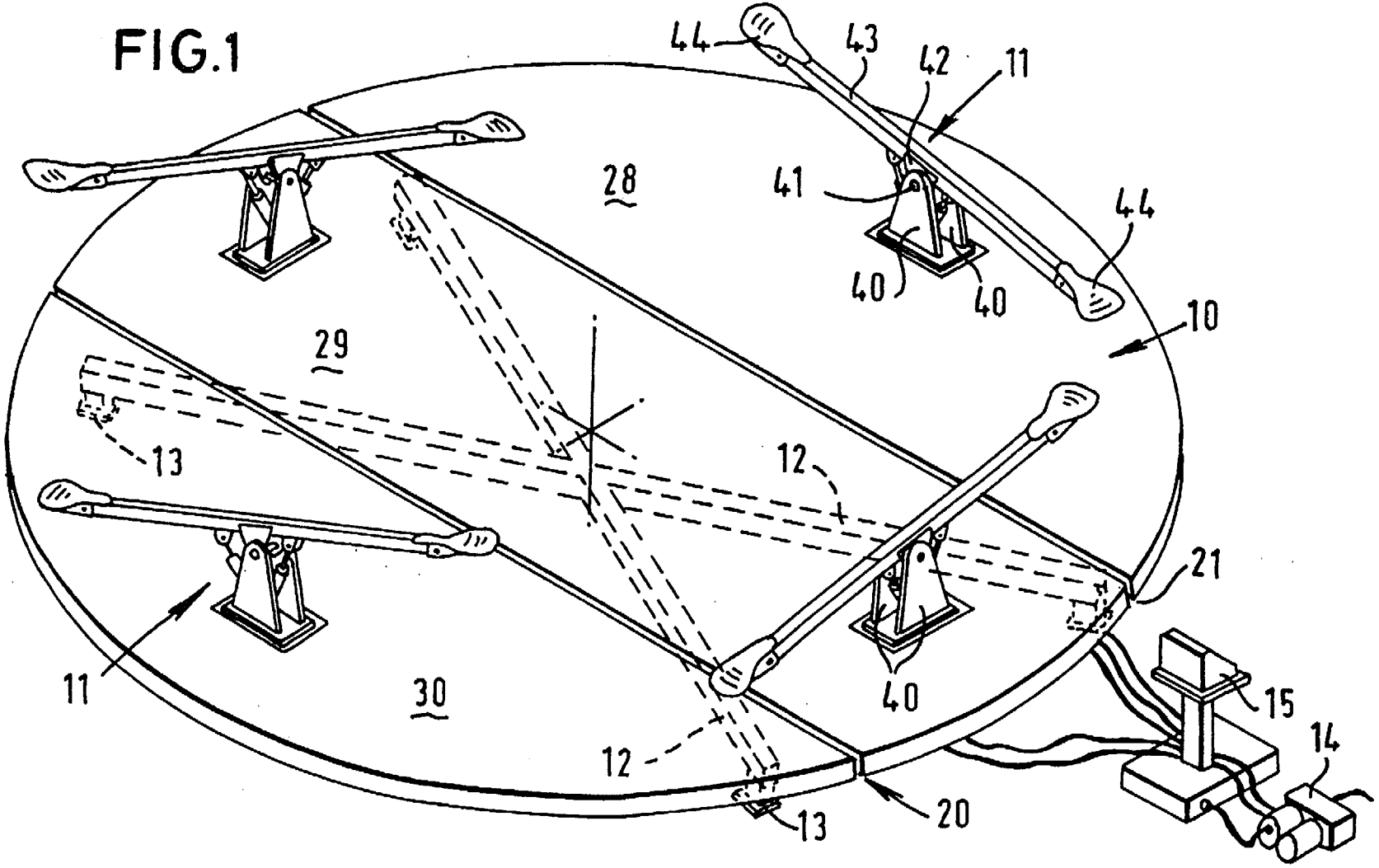
FIG. 1 is a diagrammatic perspective view of a static embodiment of a carousel of this invention.

Illustrated in FIG. 1 is a static carousel of this invention. This comprises a turntable 10 carrying four see-saw arrangements 11. The turntable 10 is rotatably mounted about a vertical axis on a frame 12 having feet 13 suitably bolted or otherwise attached to the ground. The carousel is hydraulically operated and there is provided a hydraulic pump arrangement 14, for example driven by an electric motor or a diesel or petrol engine, together with an operator's control console 15.

Figure 2:
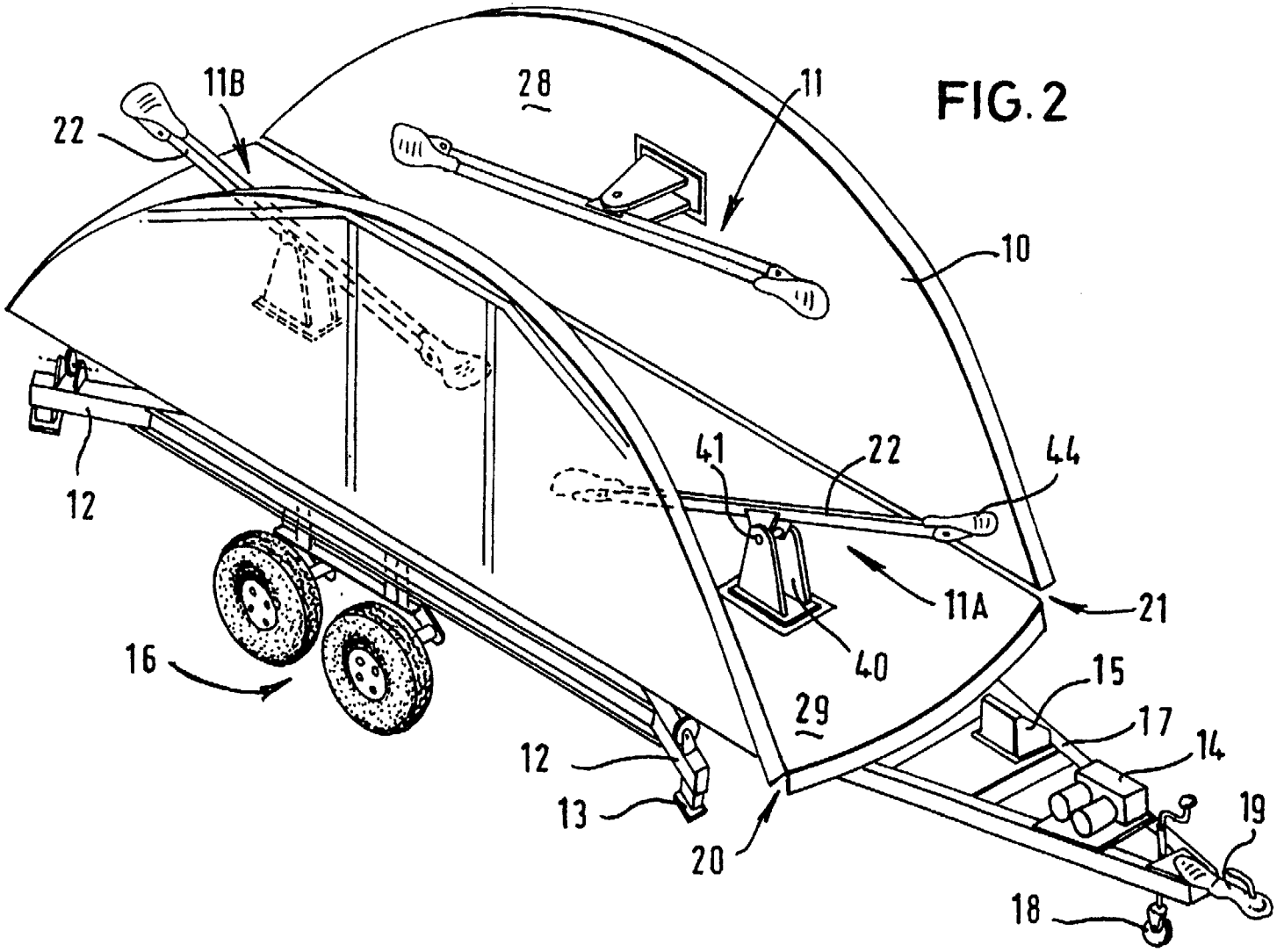
FIG. 2 is a view similar to that of FIG. 1, but of a mobile embodiment of carousel.
Figure 3:
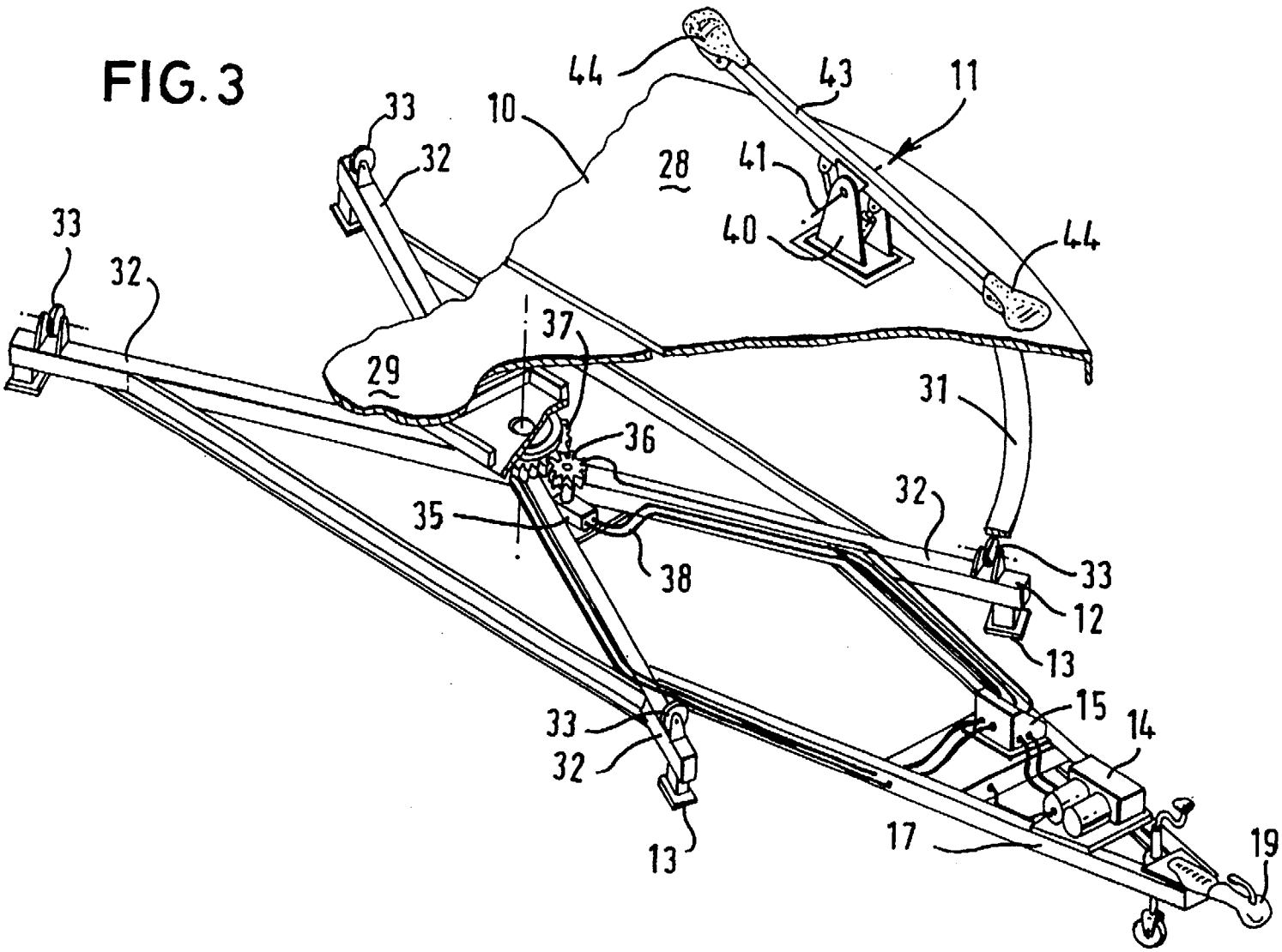
FIG. 3 is a partial cut-away view of the carousel of FIG. 2.
Figure 4:
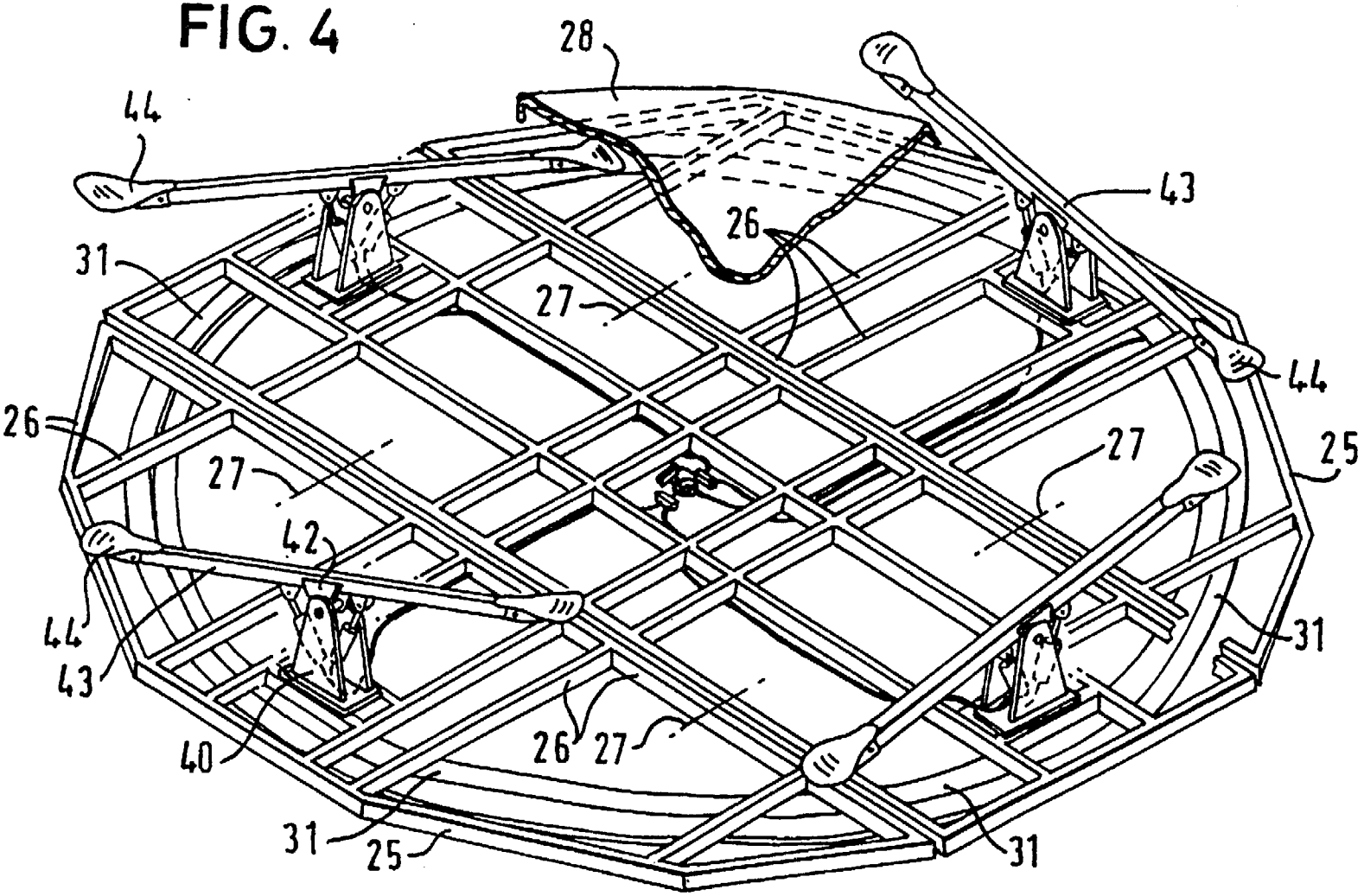
FIG. 4 is a detailed view, partially cut-away, of the turntable for use in the carousels of FIGS. 1 or 2.

FIGS. 2 and 3 show a generally similar carousel arrangement, but here the frame 12 is releasably mounted on a two-wheeled bogey 16, whereby the carousel may be moved from place to place. To this end, the frame 12 includes a draw-bar 17 having a jockey wheel 18 and a socket part 19 of a ball hitch. The hydraulic pump 14 is mounted on the draw bar 17, as is the operator's console 15. When the carousel is to be used, either the bogey may be removed, so that the feet 13 may bear on the ground, or the feet may be made extendible, so that the bogey may be left in place.

As will be appreciated, the turntable 10 is arranged to be foldable about two parallel lines 20 and 21, whereby the effective width of that turntable may greatly be reduced for transport purposes. To permit this, the mountings for two opposed see-saw arrangements 11A and 11B may be turned through 90°, whereby the see-saw arms 22 extend parallel to the arms of the other two see-saw arrangements.

The turntable 10 comprises three separate frameworks 25 of box members 26, which frameworks are bolted together at 27. Each framework supports a respective platform part 28, 29 and 30. When the carousel is to be moved, the bolts between the frameworks are removed and the two outer frameworks are pivoted upwardly as shown in FIG. 2. Below each framework, there is provided part of an essentially continuous annular track 31. Mounted on the four arms 32 of the frame 12 are respective wheels 33, positioned so that the track 31 runs on those wheels. At the center of the frame 12, there is provided a main bearing 34A, 34B (FIG. 6) for the turntable, which gives location in the radial direction. The turntable is thus positively located and stably supported for free rotation about its axis.

Rotation of the turntable 10 is effected by a hydraulic motor 35 mounted on the frame 12 and which turns a pinion 36 meshed with a main gear 37 formed externally around the outer race 34B of the main bearing, which outer race is attached to the underside of the turntable framework. Hydraulic lines 38 connect the motor 35 back to the console 15.

Each see-saw assembly 11 comprises a pair of trunnion plates 40 upstanding from the turntable platform, with a shaft 41 extending between their upper ends. Journalled on that shaft 41 are a pair of plates 42 attached to opposite sides of a see-saw arm 43, the two free ends of that arm 43 carrying respective seats 44. A pair of single acting hydraulic rams 45 are pivoted to a bracket mounted between the trunnion plates 40, the piston rods of the rams being pivoted to the see-saw arm 43, respectively on opposite sides of the shaft 41. Hydraulic hoses 46 connect the rams 45 back to the console 15, through a rotary hydraulic coupling 47, shown in FIG. 6.

The coupling 47 comprises a central part 48 attached to the box members 26 of the central framework of the turntable, which central part 48 includes a pair of L-shaped passageways 49 and 50. The upper (axial) ends of the passageways 49 and 50 are internally threaded to receive connectors on the ends of the flexible hoses 46, leading to the rams 45. An outer part 51 is supported by plurality of arms 52 attached to the static frame 12, to surround the central part 48. The outer part 51 has a pair of axially-spaced galleries 53, with seals 54 being disposes to each side of each gallery. The galleries are in respective axial alignment with the radial ends of the passageways 49 and 50 and include hose connectors 55 and 56, for flexible hoses leading to the console 15.

Figure 6:
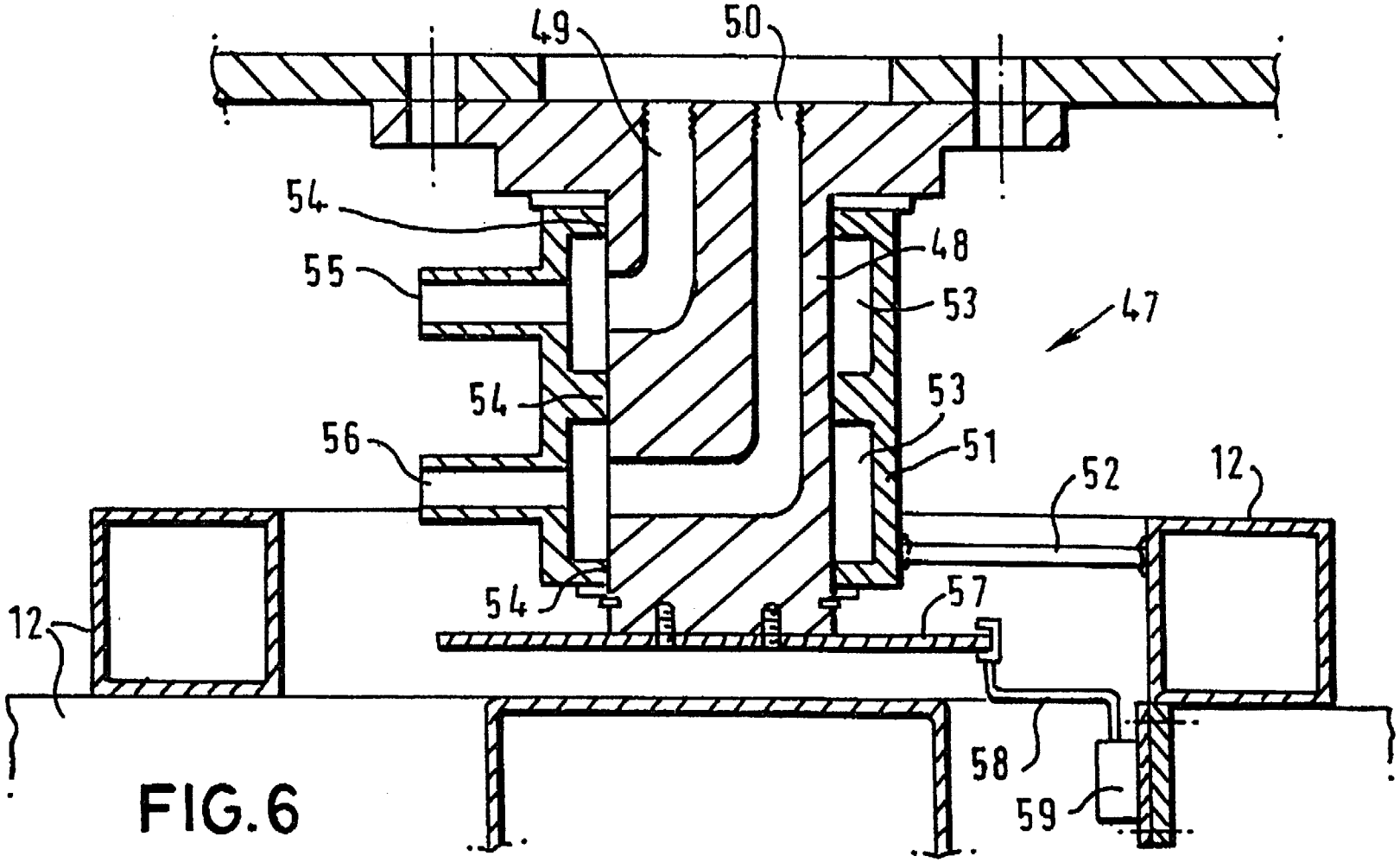
FIG. 6 is a vertical section through the central bearing assembly for the turntable.

Also shown in FIG. 6 is a cam 57 attached to the central part 48 for rotation therewith to operate a lever 58 attached to a switch 59 mounted on the frame 12. The switch 59 serves to give timing pulses to the console 15, for causing operation of the rams 45 at certain defined angular positions with respect to the frame 12.

In use, the hydraulic pump 14 is operated to produce hydraulic fluid under pressure. When fluid is supplied to the motor 35, the turntable rotates and the see-saw assemblies 11 are then also driven to perform an oscillating motion, in a timed relationship to the rotation of the turntable, under the control of switch 59. Of course, should the operator so wish, the movement of the see-saws may be inhibited whilst the turntable rotates; conversely, the see-saws may manually be operated from the console while the turntable remains stationery. Equally, the see-saws may be manually operated irrespective of the timing pulses from switch 59, while the turntable rotates.

Figure 7:
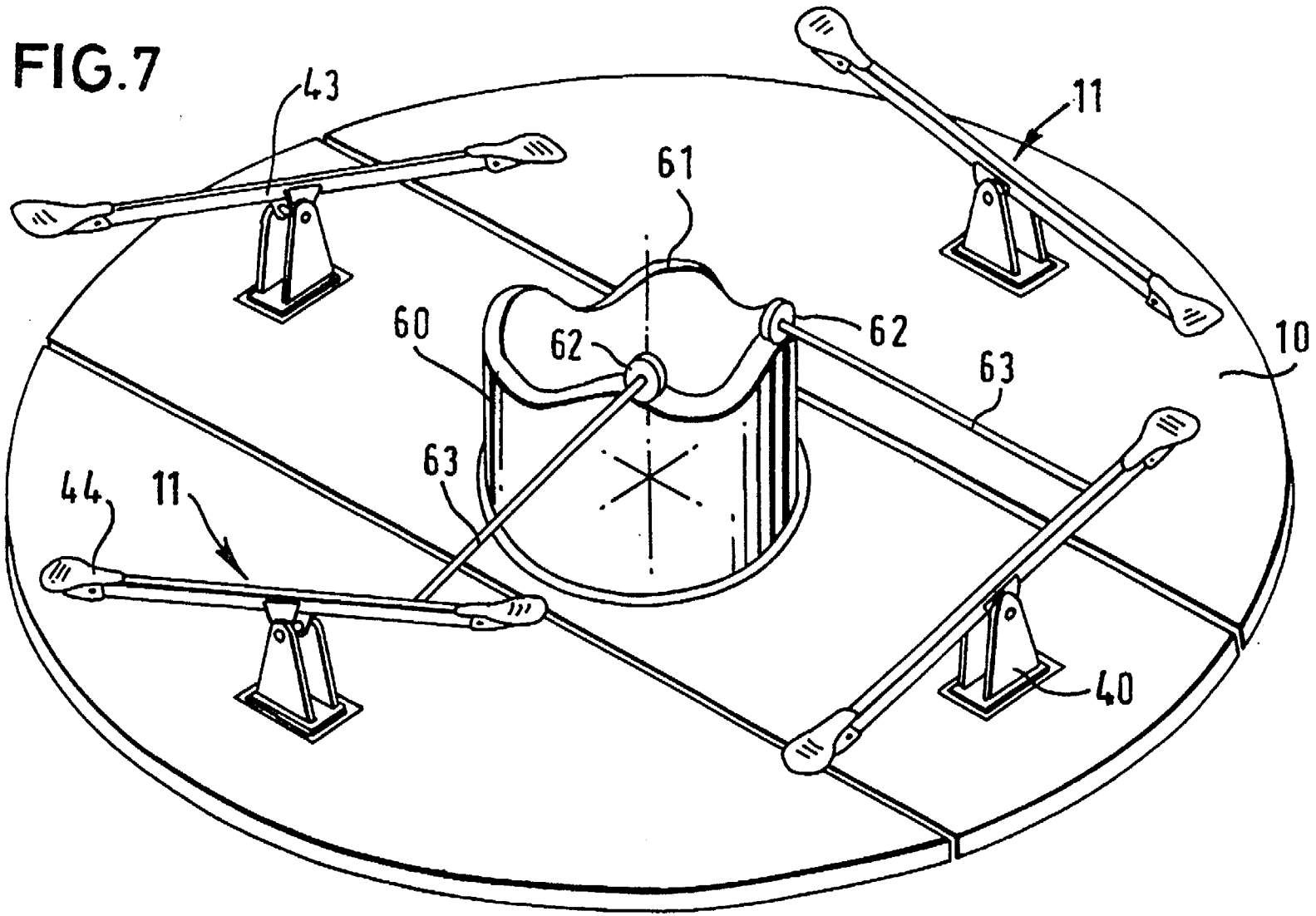
FIG. 7 is a diagram showing a mechanical arrangement for operating the see-saws.

In FIG. 7, there is shown an alternative mechanism for causing the see-saws to operate. Here, there is provided a central, static cam member 60 defining a cam profile 61 over which run cam followers 62. Each cam follower is connected by a bar 63 to an associated see-saw assembly, appropriate guides (not shown) being provided for the bars 63. A biasing arrangement (not shown, but such as a torsion spring around shaft 41) serves to bias the respective see-saw assembly in the clock-wise direction, when viewed from outside the turntable. Rotation of the turntable around the cam member 60 will thus cause the see-saw arms to oscillate.

Figure 8:
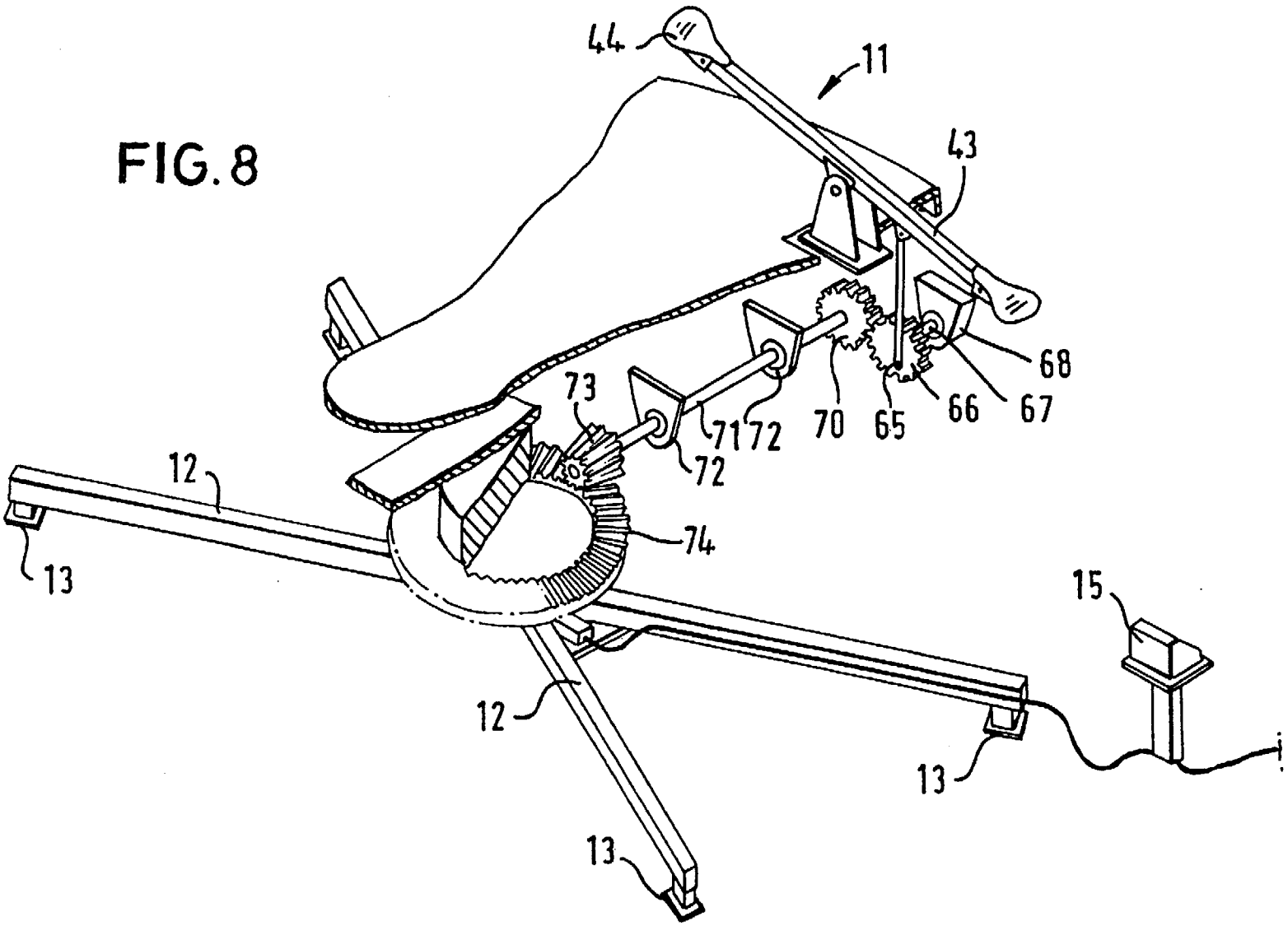
FIG. 8 is an alternative crank mechanism for operating the see-saws.

FIG. 8 shows an alternative mechanism for operating the see-saw arrangements 11. In this mechanism, a crank pin 65 is provided on a pinion 66 carried by shaft 67 journalled in a bracket 68 mounted on the underside of the framework, below a see-saw arrangement 11. The crank pin 65 is connected by a link 69 to the arm 43 of the associated see-saw assembly, to one side of its shaft 41, so that rotation of the pinion 66 causes oscillating motion of the see-saw assembly.

The pinion 66 meshes with a similar pinion 70 carried by a shaft 71 also supported below the turntable framework, by means of brackets 72. At its inboard end, shaft 71 carries a bevel gear 73 which meshes with a stationary ring gear 74 mounted on the frame 12. Rotation of the turntable thus causes rotation of the shaft 71, and so also of pinion 66, so causing the see-saw arm 43 to oscillate.

Figure 5:
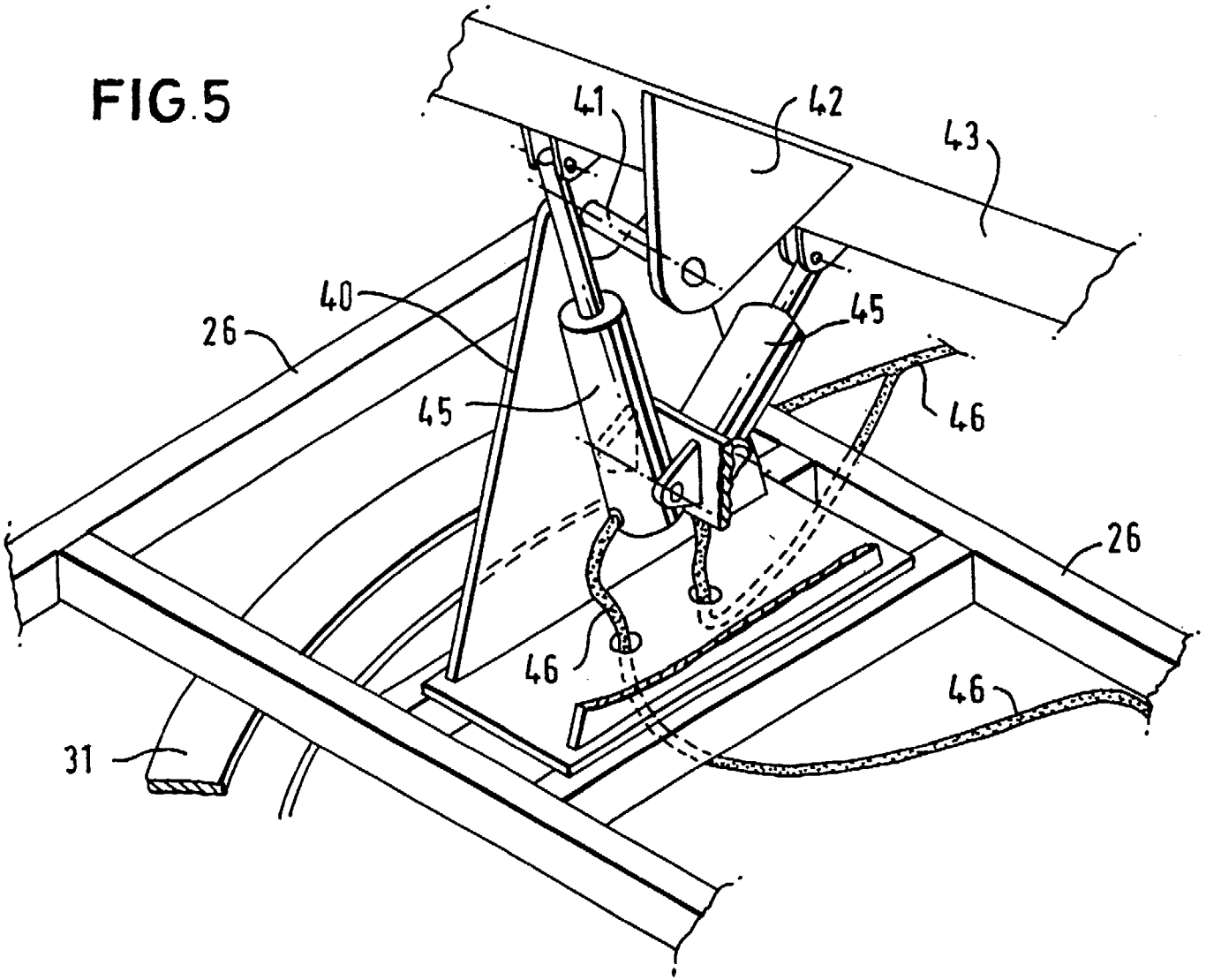
FIG. 5 is a detailed view of a see-saw pivot of the turntable of FIG. 4.
Figure 9:
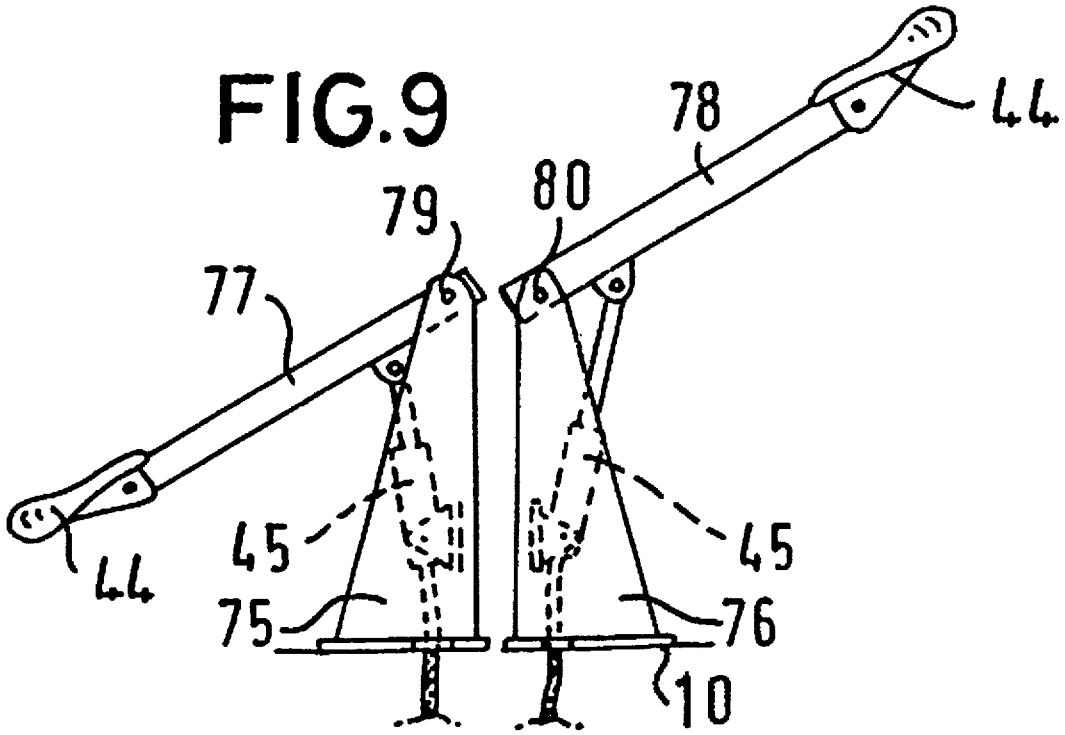
FIG. 9 illustrates an alternative see-saw arrangement.

In FIG. 9, there is shown an alternative see-saw arrangement, which comprises two pairs of trunnion plates 75 and 76, upstanding from the turntable 10 in a closely spaced manner. Each pair of plates pivotally mounts a respective but independent see-saw arm 77 and 78, about a respective shaft 79 and 80. Each arm is connected by a respective single-acting ram 45 to the associated trunnion plates, in a generally similar manner to that described above particularly with reference to FIG. 5. In this alternative see-saw arrangement, the rams may be operated in antiphase, as with the arrangement of FIG. 5, so that the arms 77 and 78 rise and fall alternately. The control arrangement could instead be configured to allow the two arms to rise and fall in synchronism or even in a random manner.

I claim:

1. Carousel apparatus comprising a turntable rotatably mounted for rotation about a vertical axis, a plurality of pairs of arms disposed around and pivotally mounted on the turntable, each arm supporting a respective seat at or adjacent its end remote from its pivotal mounting to the turntable, power-turning means to effect rotation of the turntable, and drive means to effect pivoting movement of the arms and so raising and lowering of the seats, the pivoting movement of the arms of each pair being in antiphase whereby the two seats of each pair of arms are alternately raised and lowered during rotation of the turntable.

2. Carousel apparatus as claimed in claim 1, wherein the two arms of each pair thereof together comprise a single elongate lever pivoted substantially at its mid-point to the mounting on the turntable, the two seats being mounted one on each end of the lever, thereby to define a see-saw.

3. Carousel apparatus as claimed in claim 2, wherein the pivotal axis for each lever defining a pair of arms extends substantially radially of the turntable.

4. Carousel apparatus as claimed in claim 1, wherein the drive means for the seats comprises a stationary cam track, and a plurality of cam followers associated with the seats which cam followers are arranged to run along the cam track during turntable rotation to effect raising and lowering of the seats.

5. Carousel apparatus as claimed in claim 1, wherein a double-acting hydraulic ram is associated with each pair of seats to effect raising and lowering of the seats in antiphase, there being a hydraulic control arrangement to control the operation of each said ram.

6. Carousel apparatus as claimed in claim 1, wherein a pair of single-acting hydraulic rams is associated with each pair of seats to effect raising and lowering of the seats in antiphase, there being a hydraulic control arrangement to control the operation of the rams of each said pair thereof.

7. Carousel apparatus as claimed in claim 1, wherein, for each pair of seats, there is provided a crank coupled by a connecting rod to the seats, each crank being rotated during rotation of the turntable so as thereby to effect raising and lowering of the seats in antiphase.

8. Carousel apparatus as claimed in claim 1, wherein the power-turning means comprises a hydraulic motor coupled to the turntable, there being a source of hydraulic fluid under pressure coupled to the motor to effect operation thereof.

9. Carousel apparatus as claimed in claim 1, wherein the turntable is mounted on a base frame, which base frame is provided with ground wheels whereby the carousel may be moved from place to place.

10. Carousel apparatus comprising a turntable rotatably mounted for rotation about a vertical axis, a plurality of enlongate levers disposed around and pivotally mounted on the turntable, a pivotal connection being arranged substantially at the mid-point of each lever to mount said lever on the turntable, each lever supporting a respective seat at or adjacent its two ends, power-turning means to effect rotation of the turntable, and drive means to effect pivoting movement of the levers, the pivoting movement of the levers causing and the two seats of each lever to be alternately raised and lowered in antiphase during rotation of the turntable.

11. Carousel apparatus as claimed in claim 10, wherein the pivotal axis for each lever extends substantially radially of the turntable.

12. Carousel apparatus as claimed in claim 11, wherein the drive means for the levers comprises a stationary cam track, and a plurality of cam followers associated with the levers which cam followers are arranged to run along the cam track during turntable rotation to effect raising and lowering of the seats.

13. Carousel apparatus as claimed in claim 10, wherein a double-acting hydraulic ram is associated with each lever to effect raising and lowering of the seats in antiphase, there being a hydraulic control arrangement to control the operation of each said ram.

14. Carousel apparatus as claimed in claim 10, wherein, for each pair of lever, there is provided a crank coupled by a connecting rod to the lever, each crank being rotated during rotation of the turntable so as thereby to effect raising and lowering of the seats in antiphase.

* * * * *